US008858873B2

(12) United States Patent
Mittendorf

(10) Patent No.: US 8,858,873 B2
(45) Date of Patent: Oct. 14, 2014

(54) NICKEL-BASED SUPERALLOYS FOR USE ON TURBINE BLADES

(71) Applicant: Honeywell International Inc., Morristown, NJ (US)

(72) Inventor: Don Mittendorf, Mesa, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/675,439

(22) Filed: Nov. 13, 2012

(65) Prior Publication Data

US 2014/0134353 A1 May 15, 2014

(51) Int. Cl.

| | |
|---|---|
| ***C22C 19/03*** | (2006.01) |
| ***C23C 14/14*** | (2006.01) |
| ***C22C 19/05*** | (2006.01) |
| ***F01D 5/28*** | (2006.01) |

(52) U.S. Cl.

CPC ..... *C22C 19/05* (2013.01); *C22C 19/03* (2013.01); *C22C 19/057* (2013.01); *F01D 5/28* (2013.01)

USPC ..... 420/441; 420/445; 420/460; 427/597

(58) Field of Classification Search

None

See application file for complete search history.

(56) References Cited

U.S. PATENT DOCUMENTS

| | | | | |
|---|---|---|---|---|
| 4,152,488 | A | 5/1979 | Schilke et al. | |
| 5,366,695 | A * | 11/1994 | Erickson | 420/448 |
| 5,395,584 | A | 3/1995 | Berger et al. | |
| 5,622,638 | A | 4/1997 | Schell et al. | |
| 5,705,281 | A | 1/1998 | Reeves et al. | |
| 2005/0194363 | A1 * | 9/2005 | Hu et al. | 219/121.64 |
| 2005/0224144 | A1 | 10/2005 | Pollock et al. | |
| 2005/0238526 | A1 | 10/2005 | Schall | |
| 2006/0219330 | A1 | 10/2006 | Hu et al. | |
| 2006/0239852 | A1 | 10/2006 | Shipton et al. | |
| 2009/0117282 | A1 | 5/2009 | Arikawa et al. | |
| 2009/0123290 | A1 | 5/2009 | Imano et al. | |
| 2009/0196760 | A1 * | 8/2009 | Harada et al. | 416/241 R |
| 2009/0252613 | A1 | 10/2009 | Gorman et al. | |
| 2010/0012235 | A1 * | 1/2010 | Gleeson et al. | 148/675 |
| 2010/0279148 | A1 | 11/2010 | Hu | |
| 2011/0097599 | A1 | 4/2011 | Hu | |
| 2011/0103968 | A1 | 5/2011 | Hoebel et al. | |

FOREIGN PATENT DOCUMENTS

| | | | | |
|---|---|---|---|---|
| EP | 0683239 | * | 1/1999 | C22C 19/05 |
| EP | 1201778 | A2 | 5/2002 | |
| EP | 1930455 | A1 | 6/2008 | |
| EP | 2110449 | A1 | 10/2009 | |

OTHER PUBLICATIONS

EP Search Report, EP 13187625.2-1353 dated Mar. 18, 2014.
EP Communication, EP 13 187 625.2-1353 dated Aug. 4, 2014.

* cited by examiner

*Primary Examiner* — Timothy Meeks
*Assistant Examiner* — Ina Agaj
(74) *Attorney, Agent, or Firm* — Ingrassia Fisher & Lorenz, P.C.

(57) ABSTRACT

A nickel-based super alloy includes, by weight, about 1.5% to about 5.5% chromium, about 8% to about 12% aluminum, about 4% to about 8% tantalum, about 1.5% to about 5.5% tungsten, less than about 1% of one or more of elements selected from a group consisting of carbon, boron, zirconium, yttrium, hafnium, and silicon, and a balance of nickel.

5 Claims, 3 Drawing Sheets

NICKEL-BASED SUPERALLOYS FOR USE ON TURBINE BLADES

TECHNICAL FIELD

The inventive subject matter generally relates to turbine engine components, and more particularly relates to nickel-based superalloys for manufacturing turbine engine components, such as turbine blades.

BACKGROUND

Turbine engines are used as the primary power source for various kinds of aircraft. The engines may also serve as auxiliary power sources that drive air compressors, hydraulic pumps, and industrial electrical power generators. Most turbine engines generally follow the same basic power generation procedure. Compressed air is mixed with fuel and burned, and the expanding hot combustion gases are directed against stationary turbine vanes in the engine. The vanes turn the high velocity gas flow partially sideways to impinge onto turbine blades mounted on a rotatable turbine disk. The force of the impinging gas causes the turbine disk to spin at high speed. Jet propulsion engines use the power created by the rotating turbine disk to draw more air into the engine, and the high velocity combustion gas is passed out of the gas turbine aft end to create forward thrust. Turbine engines are also used to drive one or more propellers, electrical generators, or other devices.

Turbine engine blades and vanes are fabricated from high temperature materials such as nickel-based superalloys. Although nickel-based superalloys have good high temperature properties and many other advantages, they may be susceptible to corrosion, oxidation, thermal fatigue, and erosion damage in the harsh environment of an operating turbine engine. These limitations may be undesirable as there is a constant drive to increase engine operating temperatures in order to increase fuel efficiency and to reduce emission. Replacing damaged turbine engine components made from nickel-based superalloys may be relatively expensive. Hence, significant research is being performed to find cost-effective ways to improve the temperature properties of these components.

Accordingly, there is a need for methods and materials for improving turbine engine components such as turbine blades and vanes. There is a particular need for environment-resistant materials that will improve a turbine component's durability. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Nickel-based superalloys, turbine blades, and methods of manufacturing turbine blades are provided.

In an embodiment, by way of example only, a nickel-based super alloy includes, by weight, about 1.5% to about 5.5% chromium, about 8% to about 12% aluminum, about 4% to about 8% tantalum, about 1.5% to about 5.5% tungsten, less than about 1% of one or more of elements selected from a group consisting of carbon, boron, zirconium, yttrium, hafnium, and silicon, and a balance of nickel.

In another embodiment, by way of example only, a nickel-based super alloy includes, by weight, about 1.5% to about 5.5% chromium, about 8% to about 12% aluminum, about 4% to about 8% tantalum, about 1.5% to about 5.5% tungsten, less than about 1% total combined weight of each of the following elements: carbon, boron, zirconium, yttrium, hafnium, and silicon, wherein each of the said elements is present in an amount greater than 0.01%, and a balance of nickel.

In still another embodiment, by way of example only, a method of manufacturing a turbine blade includes applying a nickel-based superalloy over an area of the blade, the nickel-based-superalloy including, by weight, about 1.5% to about 5.5% chromium, about 8% to about 12% aluminum, about 4% to about 8% tantalum, about 1.5% to about 5.5% tungsten, less than about 1% of one or more of elements selected from a group consisting of carbon, boron, zirconium, yttrium, hafnium, and silicon, and a balance of nickel.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. Furthermore, as used herein, numerical ordinals such as "first," "second," "third," etc., such as first, second, and third components, simply denote different singles of a plurality unless specifically defined by language in the appended claims. All of the embodiments and implementations of the stator airfoil assemblies and methods for the manufacture thereof described herein are exemplary embodiments provided to enable persons skilled in the art to make or use the invention and not to limit the scope of the invention, which is defined by the claims. Furthermore, there is no intention to be bound by any expressed or implied theory presented in the preceding technical field, background, brief summary, or the following detailed description.

An improved, nickel-based superalloy is provided that has superior elevated-temperature properties over those of conventional superalloys. In an embodiment, the nickel-based superalloy has improved oxidation-resistance when exposed to engine operating temperatures, such as turbine inlet temperatures greater than about 2200° F. (1205° C.). In an example, the nickel-based superalloy may have improved properties, such as resistance to creep, oxidation, thermal fatigue, and other hazards when used for high pressure turbine (HPT) components such as turbine blades and vanes.

Figure 1:
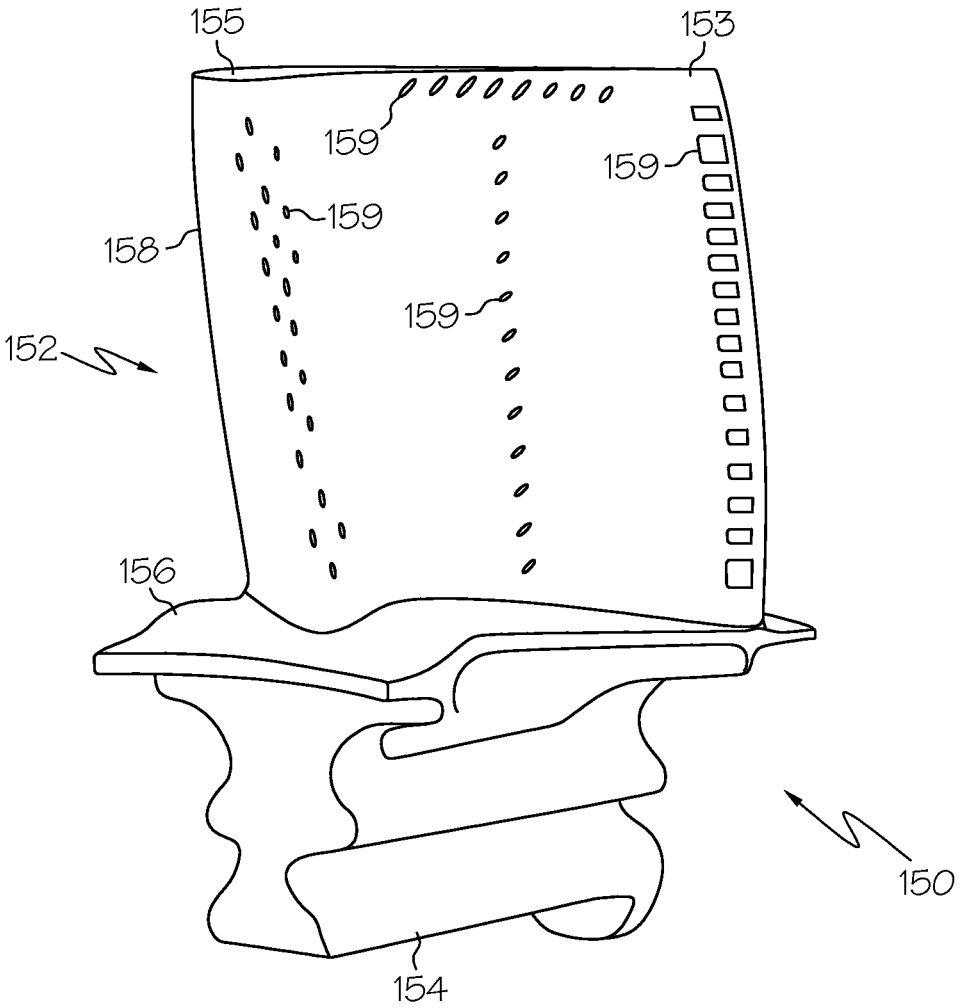
FIG. 1 is a perspective view of a turbine engine component, according to an embodiment.

FIG. 1 is a perspective view of a turbine engine component 150, according to an embodiment. Here, the turbine engine component 150 is shown as a turbine blade. However, in other embodiments, the turbine engine component 150 may be a turbine vane or other component that may be implemented in a gas turbine engine, or other high-temperature system. In an embodiment, the turbine engine component 150 may include an airfoil 152 that includes a pressure side surface 153, an attachment portion 154, a leading edge 158 including a blade tip 155, and/or a platform 156. In accordance with an embodiment, the turbine engine component 150 may be formed with a non-illustrated outer shroud attached to the tip 155. The turbine engine component 150 may have non-illustrated internal air-cooling passages that remove heat from the turbine airfoil. After the internal air has absorbed heat from the blade, the air is discharged into a hot gas flow path through passages 159 in the airfoil wall. Although the turbine engine component 150 is illustrated as including certain parts and having a particular shape and dimension, different shapes, dimensions and sizes may be alternatively employed depending on particular gas turbine engine models and particular applications.

Figure 2:
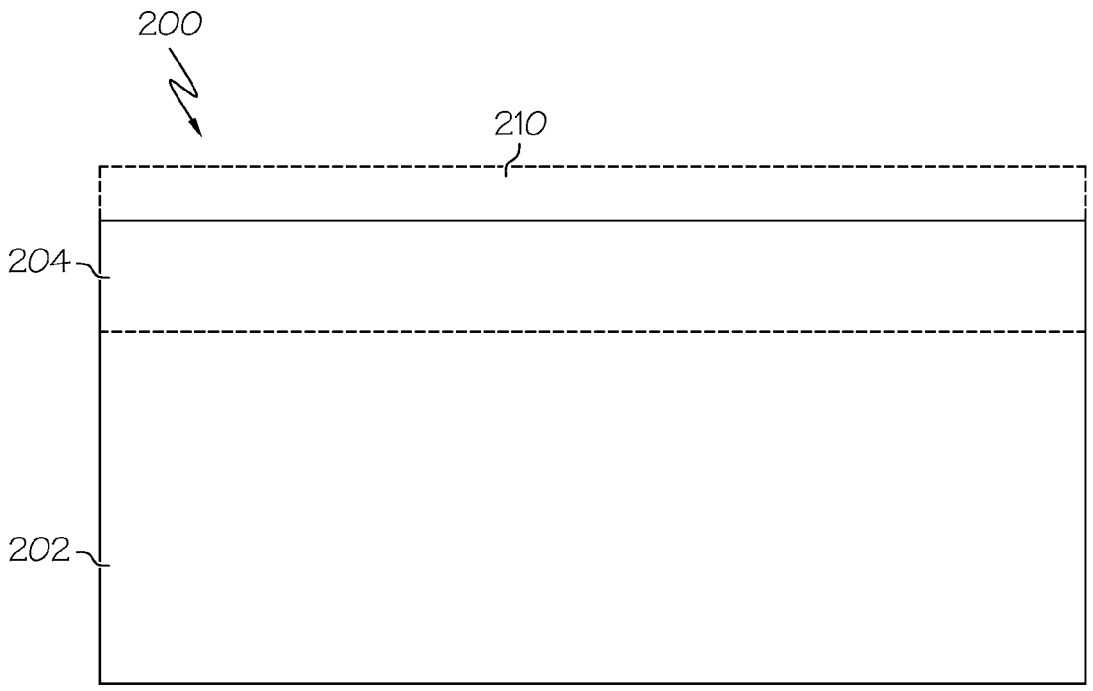
FIG. 2 is a cross-sectional view of a portion of a turbine engine component, according to an embodiment.

FIG. 2 is a cross-sectional view of a portion of an improved turbine engine component 200, according to an embodiment. The portion may be included on the tip of a blade, in an embodiment. In another embodiment, the portion may be included on the blade platform. In any case, the turbine engine component 200 may include a base material 202 and an enhanced portion 204 comprised of the improved, nickel-based superalloy. Though a dotted line is shown between the base material 202 and the enhanced portion 204, it will be appreciated that in an embodiment, an interface between the alloys of the base material 202 and the enhanced portion 204 may be seamless and may be a metallurgical bonding or a metallurgical interface. In some embodiments, as shown in phantom, a protective coating system 210 may optionally be deposited over the turbine engine component 200.

In an embodiment, the base material 202 comprises a first nickel-based superalloy. For example, the first nickel-based superalloy may be selected from a high performance nickel-based superalloy, including, but not limited to IN792, C101, MarM247, Rene80, Rene125, ReneN5, SC180, CMSX 4, and PWA1484. The base material 202 may have a single crystal microstructure, in an embodiment. In other embodiments, the base material 202 may comprise a directionally solidified or an equiaxed microstructure.

The enhanced portion 204 includes a second nickel-based superalloy having a composition that may or may not be different than the composition of the first nickel-based superalloy. Generally, in an embodiment, the second nickel-based superalloy includes elements selected from nickel, chromium, aluminum, tantalum, hafnium, silicon, and yttrium. In other embodiments, in addition to the previously-mentioned elements, the second nickel-based superalloy may include one or more elements selected from carbon, boron, and zirconium. In yet another embodiment, the nickel-based superalloy further may include tungsten. In still another embodiment, the nickel-based superalloy may include incidental impurities (e.g., trace amounts of additional elements that are not intentionally included in the composition), but does not include other elements other than those listed previously.

In accordance with an embodiment, the second nickel-based superalloy includes, by weight, about 1.5% to about 5.5% chromium, about 8% to about 12% aluminum, about 4% to about 8% tantalum, about 0.05% to about 0.25% hafnium, about 0.01% to about 0.05% yttrium, about 0.1% to about 0.5% silicon, about 1.5% to about 5.5% tungsten, and a balance of nickel. In still another embodiment, the second nickel-based superalloy optionally or additionally may include, by weight, up to about 0.1% carbon (in an amount greater than about 0.01%). In still yet another embodiment, the second nickel-based superalloy optionally or additionally may include, by weight, up to about 0.1% zirconium (in an amount greater than about 0.01%). In still yet another embodiment, the second nickel-based superalloy optionally or additionally may include, by weight, up to about 0.1% boron (in an amount greater than about 0.01%).

Chromium is included to enhance the alloy's oxidation resistance. Inclusion of aluminum promotes formation of a gamma prime strengthening phase and formation of a protective aluminum oxide layer on a surface of the enhanced portion 204. The protective oxide layer protects the outer surface of the enhanced portion 204 against oxidation. Tantalum may partition into gamma prime phase (e.g., segregate into particles within a gamma matrix of the superalloy) to improve the elevated-temperature creep and fatigue resistance properties of the nickel-based superalloy. This composition produces a single phase gamma prime ($Ni_3Al$) phase that is strengthened with W and Ta to resist creep. The gamma prime phase has a lower coefficient of thermal expansion than the blade alloys which are a composite of gamma and gamma prime phases. The aluminum concentration at about 8 wt % to about 12 wt % is much higher than the substrate, and in combination with the other elements, will form only the gamma prime phase. In addition the higher aluminum content produces a superior thermally grown oxide (TGO) dominated by $Al_2O_3$. Elemental additions such a Zr, Y, Hf and Si are also known to improve the thermal cyclic resistance of the TGO. Further, although the strengthening elements W and Ta have previously been known in the art to be detrimental to the TGO, it has been found unexpectedly by the inventor herein that they are much less detrimental than the combination of elements use in known blade alloys.

Further, hafnium, yttrium, zirconium, and rare earth elements may improve adhesion of the protective oxide layer to the enhanced portion 204. Specifically, the hafnium atoms of the nickel-based superalloy may diffuse into grain boundaries of the aluminum oxide scale that thermally grows very slowly on the surface the nickel-based superalloy of the enhanced portion 204 so that the protective oxide layer remains relatively thin. As a result, spallation of the protective oxide layer may be minimized. Moreover, hafnium, yttrium, and/or other reactive elements such as zirconium or the rare earth elements may be included in the composition of the nickel-based superalloy to tie up the sulfur impurities that may be present in the material of the enhanced portion 204. In particular, yttrium and/or other reactive elements may react with sulfur to form stable oxysulfides or sulfides to prevent the sulfur from diffusing to the surface of the superalloy. This may also improve the adherence of a protective thin layer alumina scale to the alloy. Silicon in the nickel-based superalloy may also contribute to the adhesion protective oxide layer, which may be comprised predominately of alumina.

Carbon and boron may be included to strengthen grain boundaries that may be present in the superalloy when multiple grains are present. Total amounts of these elements are preferably minimized, because inclusion of increased quantities of these elements may adversely affect oxidation resistance at higher temperatures.

Further, in some embodiments, tungsten may be included in order to improve alloy creep strength properties of the superalloy. Tungsten is preferably minimized to less than about 5.5%, or preferably less than about 4.5%, or more preferable about 3.5% because inclusion of increased quantities of tungsten, as noted above in addition to tantalum, may adversely affect oxidation resistance at higher temperatures and alloy stability.

Figure 3:
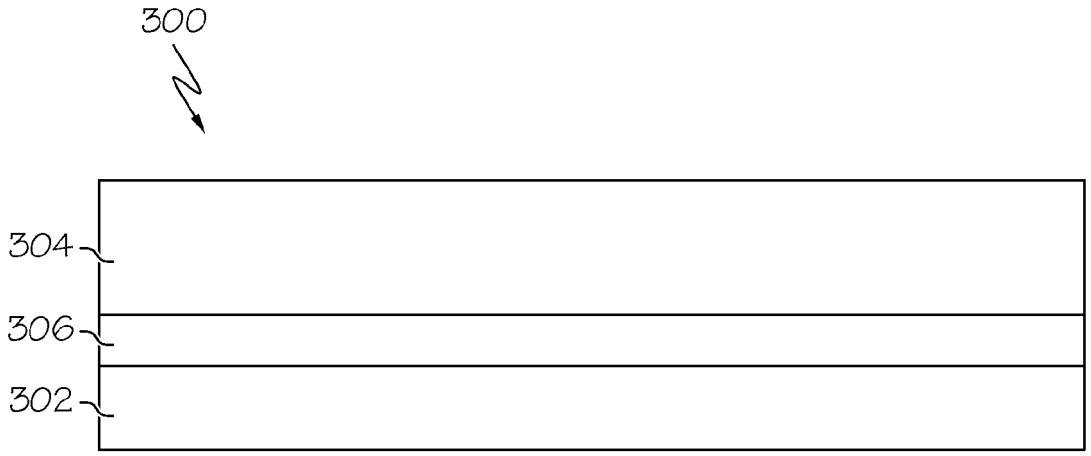
FIG. 3 is a cross-sectional view of a protective coating system that may be included over a turbine engine component, according to an embodiment.

To further protect the turbine engine component 200 which may be exposed to the harsh operating temperatures, the protective coating system 210 is optionally included, in an embodiment. FIG. 3 is a cross-sectional view of a protective coating system 300 that may be included over a turbine engine component, according to an embodiment. The protective coating system 300 may include a bond coating 302, a thermal barrier coating 304, and one or more intermediate layers therebetween, such as a thermally grown oxide (TGO) 306. In one embodiment, the bond coating 302 may be a diffusion aluminide coating. For example, the diffusion aluminide coating may be formed by depositing an aluminum layer over the base material 202 (FIG. 2) and the enhanced portion 204 (FIG. 2), and subsequently interdiffusing the aluminum layer with the substrate to form the diffusion aluminide coating. In another embodiment, the diffusion aluminide coating may have a more complex structure and may include one or more additional metallic layers that are diffused with the aluminum layer, the base material 202, and/or the enhanced portion 204. For example, an additional metallic layer may include a platinum layer.

In another embodiment, the bond coating 302 may be an overlay coating comprising MCrAlX, wherein M is an element selected from cobalt, nickel, or combinations thereof, and X is one or more elements selected from hafnium, zirconium, yttrium, tantalum, palladium, platinum, silicon, or combinations thereof. Some examples of MCrAlX compositions include NiCoCrAlY and CoNiCrAlY. In still another embodiment, the bond coating 302 may include a combination of two types of bond coatings, such as a diffusion aluminide coating formed on an MCrAlX coating. In any case, the bond coating 302 may have a thickness in a range of from about 25 microns (μm) to about 150 μm, according to an embodiment. In other embodiments, the thickness of the bond coating 302 may be greater or less.

The thermal barrier coating 304 may be formed over the bond coating 302 and may comprise, for example, a ceramic. In one example, the thermal barrier coating 304 may comprise a partially stabilized zirconia-based thermal barrier coating, such as yttria stabilized zirconia (YSZ). In an embodiment, the thermal barrier coating may comprise yttria stabilized zirconia doped with other oxides, such as $Gd_2O_3$, $TiO_2$, and the like. In another embodiment, the thermal barrier coating 304 may have a thickness that may vary and may be, for example, in a range from about 50 μm to about 300 μm. In other embodiments, the thickness of the thermal barrier coating 304 may be in a range of from about 100 μm to about 250 μm. In still other embodiments, the thermal barrier coating 304 may be thicker or thinner than the aforementioned ranges.

The thermally-grown oxide layer 306 may be located between the bond coating 302 and the thermal barrier coating 304. In an embodiment, the thermally-grown oxide layer 306 may be grown from aluminum in the above-mentioned materials that form the bond coating 302. For example, during the deposition or a subsequent heat treatment of the thermal barrier coating 304, oxidation may occur on the bond coating 302 to result in the formation of the oxide layer 306. In one embodiment, the thermally-grown oxide layer 306 may be relatively thin, and may be less than 2 μm thick.

Figure 4:
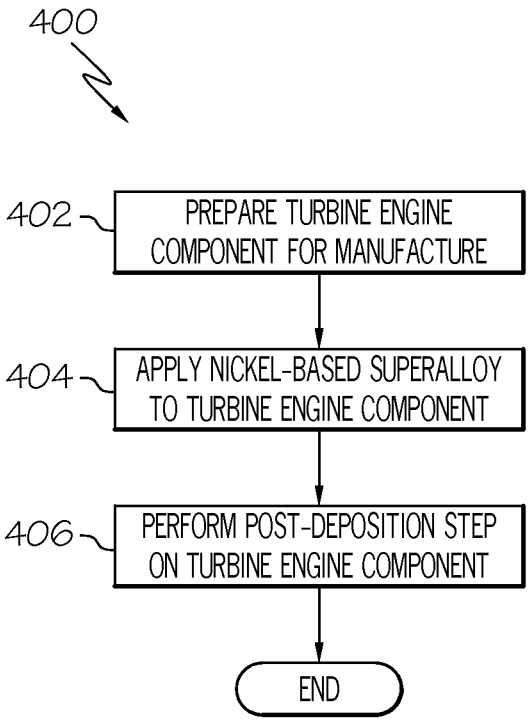
FIG. 4 is flow diagram of a method of manufacturing a turbine engine component, according to an embodiment.

To manufacture a turbine engine component, a method 400, depicted in a flow diagram provided in FIG. 4, may be employed. Although the following method 400 is described with reference to manufacture of a turbine blade, it should be understood that the method 400 is not limited to blades or any other particular components. According to an embodiment, the turbine engine component including only the base alloy 202 is prepared for the addition of the enhanced layer 204 in, for example, the tip region, step 402. In an embodiment, step 402 may include chemically preparing the surface of the turbine engine component. Thus, a chemical stripping solution may be applied to a surface of the turbine engine component, for example, nitric acid solution. However, other chemicals may alternatively be used.

In another embodiment of step 402, the turbine engine component may be mechanically prepared. Examples of mechanical preparation include, for example, pre-machining and/or degreasing surfaces in order to remove any oxidation, dirt or other contaminants that may be present from previous manufacturing steps. In another embodiment, additional or different types and numbers of preparatory steps can be performed. It will be appreciated that the present embodiment is not limited to these preparatory steps, and that additional, or different types and numbers of preparatory steps can be conducted.

Once the turbine engine component has been prepared, a nickel-based superalloy in accordance with the present disclosure may be applied to, for example, the tip region of the blade, step 404, to form layer 204 as shown in FIG. 2. In an embodiment, the nickel-based superalloy may be laser-welded onto the damaged area. The nickel-based superalloy may be provided as substantially spherical powder particles, which provide improved powder flow properties and may help maintain a stable powder feed rate during a laser deposition process. According to an embodiment, the spherical powder particles may have an average diameter in a range of about 5.0 microns to about 50.0 microns. In other embodiments, the average diameters may be smaller or greater than the aforementioned range. In an embodiment, the spherical powder particles may be prepared by vacuum or inert-gas atomization.

To laser-weld the nickel-based superalloy to the component, the nickel-based superalloy powder may be used in conjunction with a $CO_2$ laser, a YAG laser, a diode laser, or a fiber laser. In an embodiment, a welding process includes laser powder fusion welding, in which the nickel-based superalloy is laser deposited onto a degraded area to restore both geometry and dimension with metallurgically sound buildup. Both automatic and manual laser welding systems are widely used to perform laser powder fusion welding processes. An exemplary manual welding repair is described in detail in U.S. Pat. No. 6,593,540 entitled "Hand Held Powder-Fed Laser Fusion Welding Torch," the contents of which are hereby incorporated by reference in their entirety.

In accordance with an embodiment in which the component comprises a directionally solidified or single crystal microstructure, the powder particles may be deposited over the desired region, i.e. the blade tip, and a laser may be employed to melt the powder particles and an underlying portion of the component. The melted powder particles and melted portion of the component may solidify into a layer with a directionally solidified microstructure or single crystal microstructure having at least a predetermined primary orientation. As used herein, the term "predetermined primary orientation" may be defined as a direction perpendicular to a crystal lattice plane of a component. In an embodiment, the predetermined primary orientation in a component comprising a nickel-based superalloy may be denoted as a [001] direction. In an embodiment, the component may serve as the seed crystal, and the desired orientation may be in a direction that provides the component with improved creep strength and/or improved thermal fatigue strength. Hence, the improved or restored portion may grow epitaxially from the crystal structure of the component to form an extension of the single crystal microstructure of the component.

The turbine blade may thereafter be subjected to a solution heat treatment above the gamma prime solvus temperature of the nickel-based superalloy for a period in a range of about 1 to 10 hours. In other embodiments, the solution heat treatment may be longer or shorter than the aforementioned time period. The piece is then cooled to room temperature (e.g., about 20° C. to about 25° C.). The blade may be cooled to room temperature at a rate of about 50° C. per minute. In other embodiments, cooling may occur within a longer or shorter time period. By cooling the piece in a relatively short time period, an array of cuboidal gamma prime phase particles may precipitate, which may enhances creep strength in the tip region, for example. The blade may thereafter be machined to a desired shape and dimension. Although a turbine blade would be commonly heat treat by both a solution heat treatment but also a precipitation heat treatment that brings out the cuboidal gamma prime particles. However the composition of the weld tip does not require a heat treatment as such since its microstructure from solidification is predominately if not completely gamma prime. Sometimes blades can be tip welded also with a full heat treatment which typically requires an additional thermal process if the blades are platinum aluminide coated.

Returning to the flow diagram of FIG. 4, after the application step 404 is completed, at least one post-deposition step is performed on the turbine engine component, step 406. A particular post-deposition step may depend on the type of application process that was performed in step 404. In an embodiment, the post-deposition step 406 can further include additional processes that improve the mechanical properties and metallurgical integrity of the turbine engine component. Such processes may include final machining the repaired turbine engine component to a design dimension. Other processes include coating the turbine engine component with a suitable coating material such as environment-resistant diffusion aluminide and/or MCrAlY overlay coatings, coating diffusion, and aging heat treatments to homogenize microstructures and improve performance of the turbine airfoils.

An exemplary alloy compositions A is provided in Table 1 and compared with the conventional SC180 single crystal turbine blade material. This exemplary alloy has a composition tailored for both improved resistance to cyclic oxidation and creep, relative to SC180. This combination of improved properties is expected to improve the oxidation and thermal fatigue life of turbine blade tips. Formulations for each nickel-based superalloy composition are included in Table 1, by weight:

TABLE 1

| Blade tip alloy | Ni | Co | Cr | Mo | W | Ta | Al | Ti | Re | Y | Hf | Si | C | B | Zr |
|---|---|---|---|---|---|---|---|---|---|---|---|---|---|---|---|
| SC180 | Bal | 10.0 | 5.0 | 1.7 | 5.0 | 8.5 | 5.5 | 0.8 | 3.0 | 0 | 0.1 | 0 | 0 | 0 | 0 |
| Alloy A | Bal | 0 | 3.5 | 0 | 3.5 | 6.0 | 10.0 | 0 | 0 | .03 | 0.15 | 0.3 | .05 | .05 | .05 |

A novel nickel-based superalloy and methods of manufacturing turbine engine components have now been provided. The novel nickel-based superalloy may provide improved oxidation-resistance over conventional nickel-based superalloys when subjected to engine operating temperatures. Additionally, the methods in which the novel nickel-based superalloys are used may be employed not only on blades, but also on other turbine components, including, but not limited to, vanes and shrouds. The method may also improve the durability of the turbine component, thereby optimizing the operating efficiency of a turbine engine, and prolonging the operational life of turbine blades and other engine components. Though the nickel-based superalloy is described above as being used for improvement of turbine blade tips, the superalloy may alternatively be employed for casting new turbine components. In one example, the inventive alloy described herein could be employed as a blade substrate, as opposed to being used solely in the tip region.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A method of manufacturing a turbine engine component, the method comprising the step of:

applying a nickel-based superalloy over an area of the component, the nickel-based-superalloy including, by weight:

about 3.5% chromium;
about 10.0% aluminum;
about 6.0% tantalum;
about 3.5% tungsten;
about 0.05% carbon;
about 0.05% boron;
about 0.05% zirconium;
about 0.03% yttrium;
about 0.15% hafnium;
about 0.3% silicon; and
a balance of nickel.

2. The method of claim 1, wherein:

the step of applying comprises depositing the nickel-based superalloy over the area of the component using laser deposition.

3. The method of claim 2, wherein:

the step of applying comprises applying the superalloy in powder form prior to laser deposition.

4. The method of claim 1, wherein:

the area of the component is a turbine blade tip.

5. A method of manufacturing a turbine engine component, the method comprising the step of:

applying a nickel-based superalloy over an area of the component, the nickel-based-superalloy consisting of, by weight:

about 3.5% chromium;

about 10.0% aluminum;

about 6.0% tantalum;

about 3.5% tungsten;

about 0.05% carbon;

about 0.05% boron;

about 0.05% zirconium;

about 0.03% yttrium;

about 0.15% hafnium;

about 0.3% silicon; and a balance of nickel.

* * * * *